US007716794B2

(12) United States Patent
Wu

(10) Patent No.: US 7,716,794 B2
(45) Date of Patent: May 18, 2010

(54) SEATBELT BUCKLE FOR USE IN VEHICLE

(76) Inventor: Wen-Yuan Wu, No. 10, Alley 1, Lane 746, Taiping Rd., Pusin Township, Changhua County 513 (TW)

( * ) Notice: Subject to any disclaimer, the term of this patent is extended or adjusted under 35 U.S.C. 154(b) by 482 days.

(21) Appl. No.: 11/834,833

(22) Filed: Aug. 7, 2007

(65) Prior Publication Data

US 2009/0038125 A1 Feb. 12, 2009

(51) Int. Cl.
*A44B 11/28* (2006.01)

(52) U.S. Cl. ..... 24/579.11; 24/DIG. 31

(58) Field of Classification Search ..... None
See application file for complete search history.

(56) References Cited

U.S. PATENT DOCUMENTS 2,391,204 A * 12/1945 Turner et al. ..... 24/579.11
2,416,757 A * 3/1947 Johnston ..... 24/579.11
2,430,341 A * 11/1947 Johnston ..... 24/579.11
2,641,813 A * 6/1953 Loxham ..... 24/573.11
3,703,749 A * 11/1972 Pfabe ..... 24/579.11
3,747,167 A * 7/1973 Pravaz ..... 24/573.11
3,825,979 A * 7/1974 Jakob ..... 24/579.11
4,610,058 A * 9/1986 Stemmildt et al. ..... 24/579.11
4,656,700 A * 4/1987 Tanaka et al. ..... 24/579.11
7,065,843 B1 * 6/2006 Wu ..... 24/642
7,159,284 B2 * 1/2007 Gastaldi ..... 24/633

* cited by examiner

*Primary Examiner*—Jack W. Lavinder
(74) *Attorney, Agent, or Firm*—Alan Kamrath; Kamrath & Associates PA

(57) ABSTRACT

A seatbelt buckle for use in vehicle comprises a base, an intermediate loop, a fixed disc, an elastic member, an upper cover, a fixed post, four movable posts, an actuation member, a biasing element and a pressing element, wherein the intermediate loop and the fixed disc are screwed onto the base, the elastic member is secured between the intermediate loop and the fixed disc, and a plurality of snap-on recesses form between the intermediate loop and the fixed disc for the insertion of engaging members of the seatbelt, the pressing element is constructed in the form of a sheet, and one end thereof extends outwardly and includes a wave-shaped abutting segment arranged thereon, thereby lowering the production cost and saving force during unbuckling the seatbelt.

7 Claims, 9 Drawing Sheets

SEATBELT BUCKLE FOR USE IN VEHICLE

BACKGROUND OF THE INVENTION

1. Field of the Invention

The present invention relates to a seatbelt buckle, and more particularly to a seatbelt buckle for use in vehicle that may simplify the structure thereof and save force during unbuckling.

2. Description of the Prior Arts

Seatbelt is a safety equipment for use in vehicle and seatbelt buckle contains three-point and five-point types, wherein the three-point type of seatbelt buckle is commonly used in the automobiles, yet the five-point type of seatbelt buckle is applied in racing cars and children's seats, etc. Referring to FIGS. 1 and 2, a prior art five-point type of seatbelt buckle comprises a base 10, a disc member 20, an upper cover 30, a resilient element 40, a fixed pillar 50, four moveable pillars 60, an actuation member 70, a biasing element 80, and a pressing element 90, wherein the base 10 includes a plurality of receiving grooves 101, each having a peg erected therein, formed therein and a fixed grooves 102 provided therein, the disc member 20 is constructed in the form of a circular piece 201 and includes a central hole 202 arranged at the center thereof and having a transverse plate 203 disposed therein, and the circular piece 201 includes a plurality of openings 204, bores 205 and integrally formed isolation decks 206 secured thereon, such that five inserting slots 207 form therebetween and each has an elastic piece 208 mounted in the inner side thereof. The upper cover 30 includes a chamber 301 defined on one side thereof. The resilient element 40 is a conical spring, and the fixed pillar 50 in the shape of a hollow cylinder extends outwardly and includes a small-diameter segment attached on one end thereof, the movable pillar 60 in the shape of a hollow cylinder extends outwardly and includes peripheral bulge 601 affixed on one end thereof, and includes an obliquely-cut retaining portion 602 disposed at another end thereof. The actuation member 70 includes four indentions 701 arranged at the center thereof, and includes five U-shaped notches 702 provided around the rim thereof. The biasing element 80 is constructed in the shape of a cylinder and includes two engaging tabs 801 mounted on one end thereof, and includes two opposite snap-on recesses 802 and four acting protrusions 803 affixed on another end thereof. The pressing member 90 is a twisted sheet and includes a compressing segment 901 attached on one end thereof, and includes an abutting segment 902 defined on another end thereof and having two locking slots 903 formed on the bottom thereof.

In assembly, the resilient element 40 is disposed in the fixed groove 102 of the base 10, by using springs, the fixed and movable pillars 50 and 60 are placed in the receiving grooves 101 of the base 10, and the actuation member 70 and the disc member 20 are engaged with the base 10 in turn so that the fixed and movable pillars 50 and 60 slidably fit into the notches 702 of the actuation member 70, thus buckling the fixed engaging piece (not shown) into the fixed pillar 50, and screw elements may screw with the base 10 through the bores 205 of the disc member 20, the biasing element 80 engages with the transverse plate 203 of the disc member 20 by way of the two snap-on recesses 802, such that the four acting protrusions 803 abut against the four indentions 701 of the actuation member 70, and the pressing element 90 is fitted in the chamber 301 of the upper cover 30 so as to be confined therein, and then the upper cover 30 is capped onto the base 10 and the disc member 20, and by means of screw elements, the two locking slots 903 of the pressing element 90 engage with the two engaging tabs 801 of the biasing elements 80, finally by covering a cap 905, finishing the assembly of the seatbelt buckle.

In operation, movable engaging pieces (not shown) of the seatbelt are inserted from the inserting slots 207 of the disc member 20 to engage with the movable pillars 60. While unbuckling the seatbelt, the pressing element 90 is buttoned to push the biasing element 80 downwardly for contacting with the actuation member 70 such that the movable pillars 60 move downward, and by virtue of the elastic pieces 208 of the disc member 20, pushing the movable engaging pieces out of the inserting slots 207.

However, such a prior art seatbelt buckle for use in vehicle still has the following defects:

1. The structure of the disc member 20 is complicated, therefore causing a troublesome manufacture. Besides, the assembly of elastic piece 208 is difficult, resulting in a high production cost.

2. During operating the pressing element 90, the user has to consume a large amount of force.

The present invention has arisen to mitigate and/or obviate the afore-described disadvantages.

SUMMARY OF THE INVENTION

The primary object of the present invention is to provide a seatbelt buckle for use in vehicle that may simplify the structure of the seatbelt buckle and assemble the elastic member 4 easily, thereby lowering the production cost.

Another object of the present invention is to provide a seatbelt buckle for use in vehicle that may save force during unbuckling the seatbelt.

In accordance with one aspect of the present invention, there is provided a seatbelt buckle for use in vehicle comprising a base, an intermediate loop, a fixed disc, an elastic member, an upper cover, a fixed post, four movable posts, an actuation member, a biasing element and a pressing element, wherein the base includes a plurality of pegs provided thereon, by using springs, the fixed and movable posts are fitted onto pegs of the base and further slidably fitted in a notch and a cut of the actuation member respectively, the intermediate loop is constructed in the form of a circle and includes a central hole formed at the center thereof, and includes a plurality of openings and bores arranged thereon, the fixed disc is constructed in the form of a circle and includes a square tapered orifice attached at the center thereof, and includes a number of projections, each having a hollow pillar erected thereon, mounted at the bottom and adjacent to the rim thereof, a plurality of positioning tabs in response to the inner sides of the projections, the elastic member includes a through opening arranged at the center thereof, a number of flexible pieces fixed on the periphery thereof, and a plurality of positioning slots defined at the corners thereof respectively, the intermediate loop and the fixed disc are screwed onto the base, the elastic member is secured between the fixed disc and the intermediate loop, and a plurality of snap-on recesses form between the fixed disc and the intermediate loop for the insertion of engaging members of the seatbelt, and the resilient element is fitted around the fixed post, the actuation member includes a number of indentions attached thereon, for correspondingly contacting with acting protrusions of the biasing element, which is constructed in the form of an inverted V-shaped sheet, so as to extends out of the central hole of the intermediate loop, the through opening of the elastic member, and the tapered orifice of the fixed disc to bias against an abutting segment of the pressing member.

The present invention will become more obvious from the following description when taken in connection with the accompanying drawings, which show, for purpose of illustrations only, the preferred embodiment in accordance with the present invention.

DETAILED DESCRIPTION OF THE PREFERRED EMBODIMENT

Figure 1:
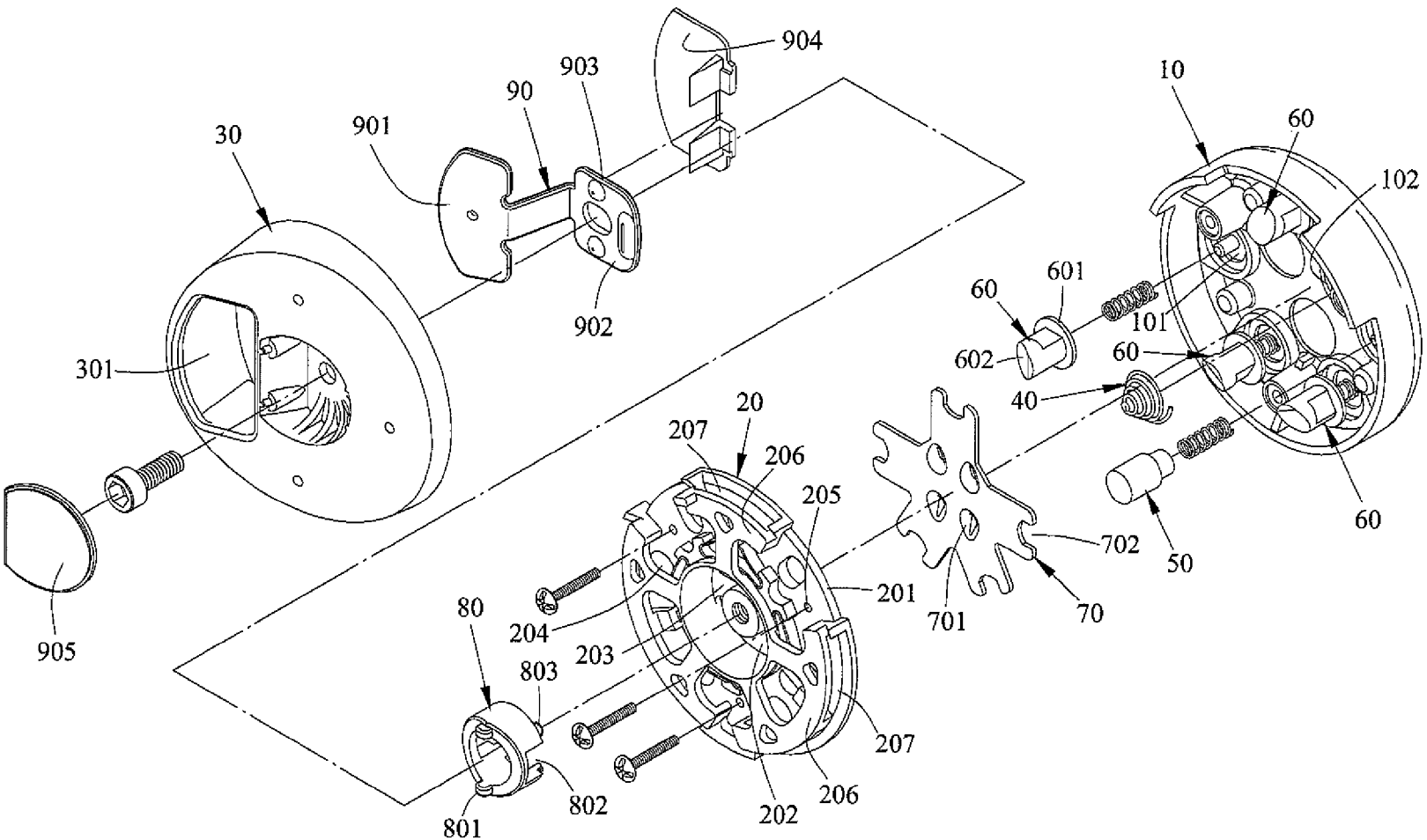
FIG. 1 PRIOR ART
FIG. 1 is a perspective diagram illustrating the exploded components of a prior art seatbelt buckle for use in vehicle.
Figure 2:
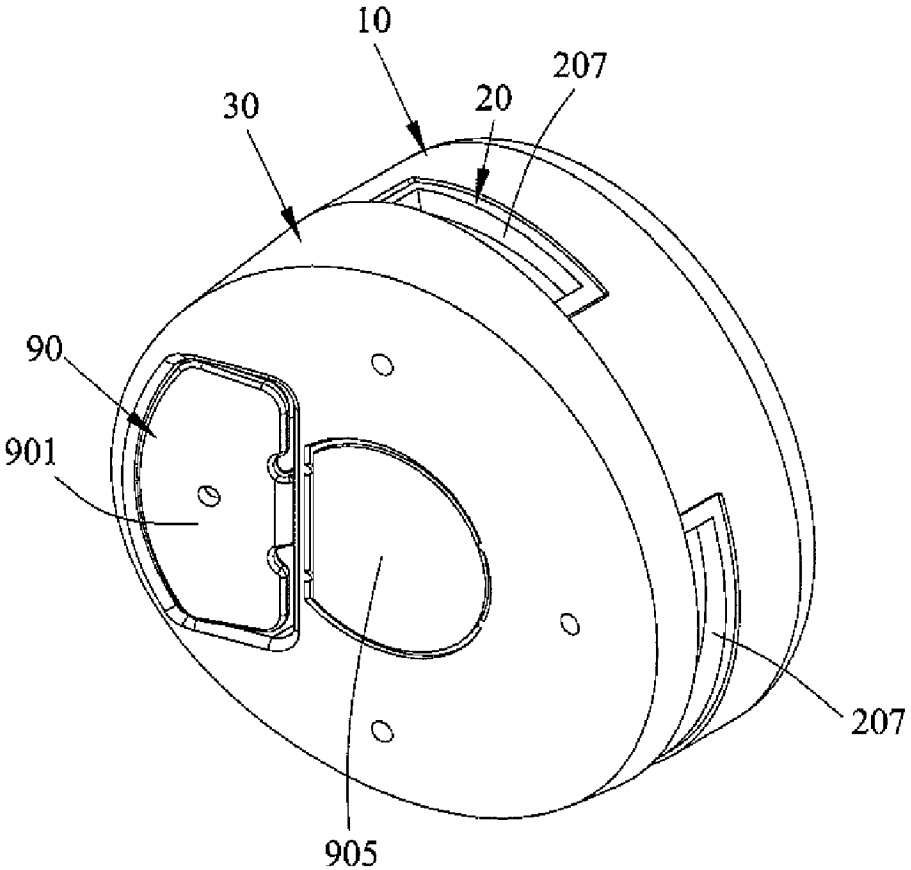
FIG. 2 PRIOR ART
FIG. 2 is a perspective diagram illustrating the assembly of the prior art seatbelt buckle for use in vehicle.
Figure 3:
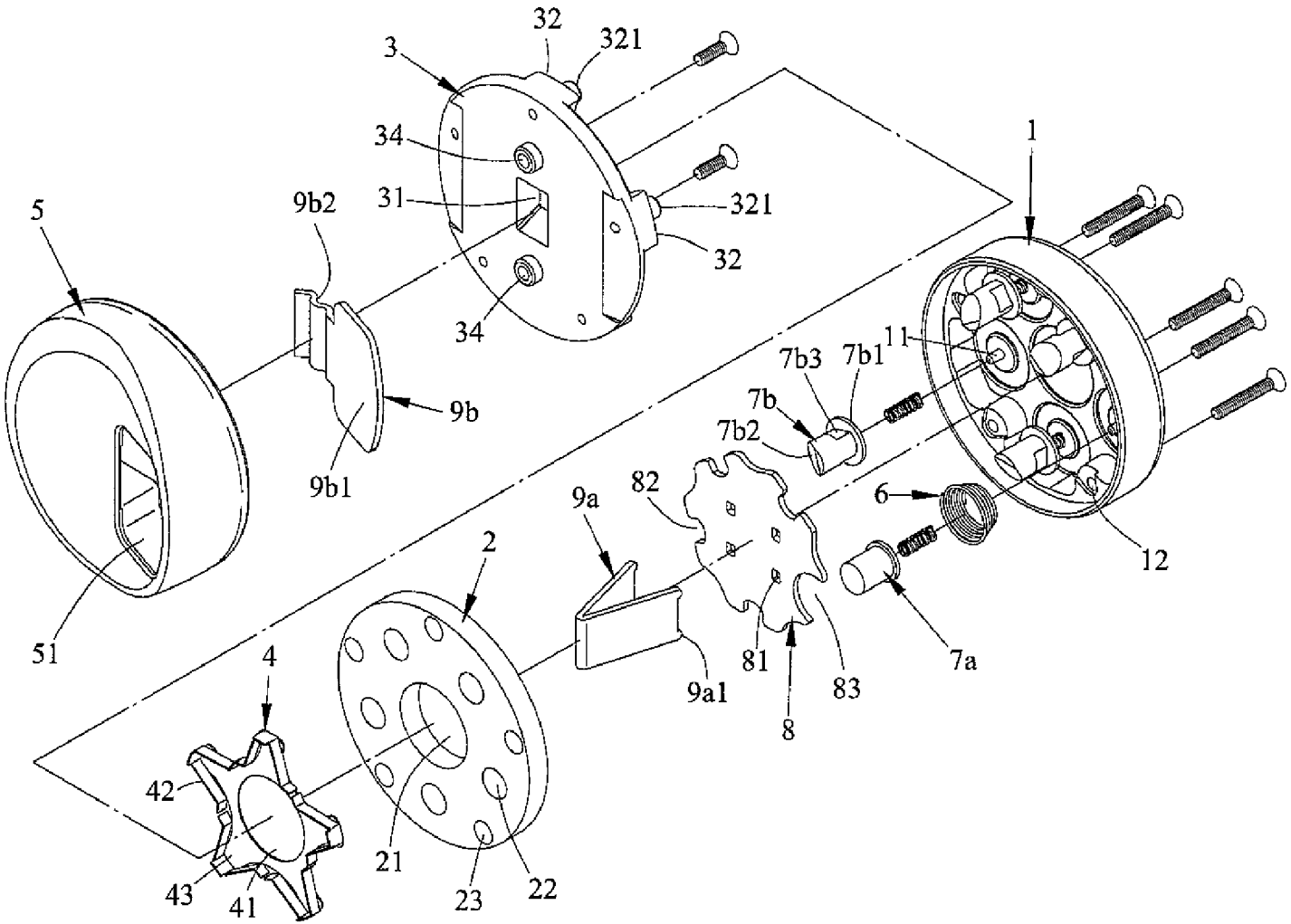
FIG. 3 is a perspective diagram illustrating the exploded components of a seatbelt buckle for use in vehicle according to the present invention.
Figure 4:
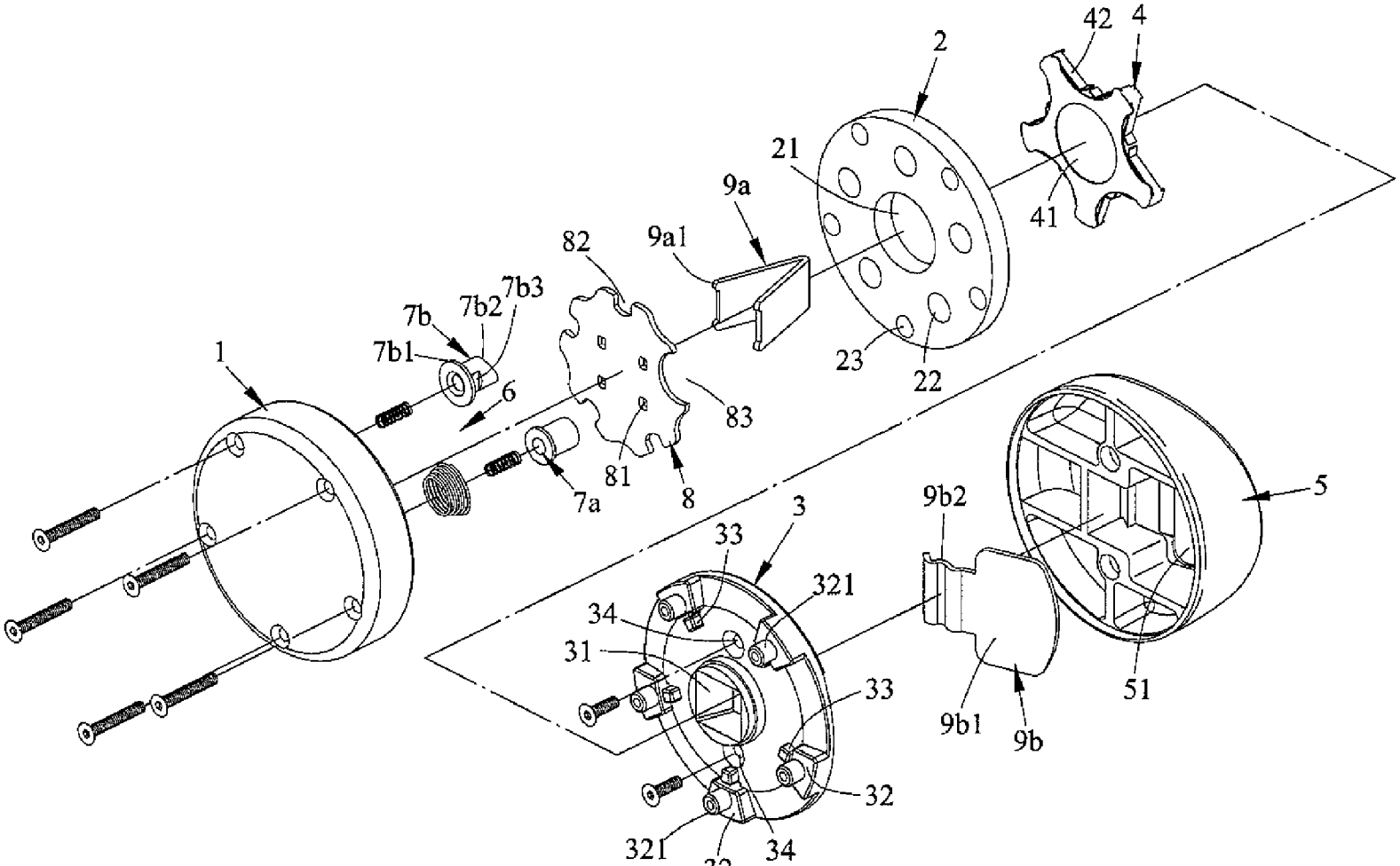
FIG. 4 is another perspective diagram illustrating the exploded components of the seatbelt buckle for use in vehicle according to the present invention.
Figure 6:
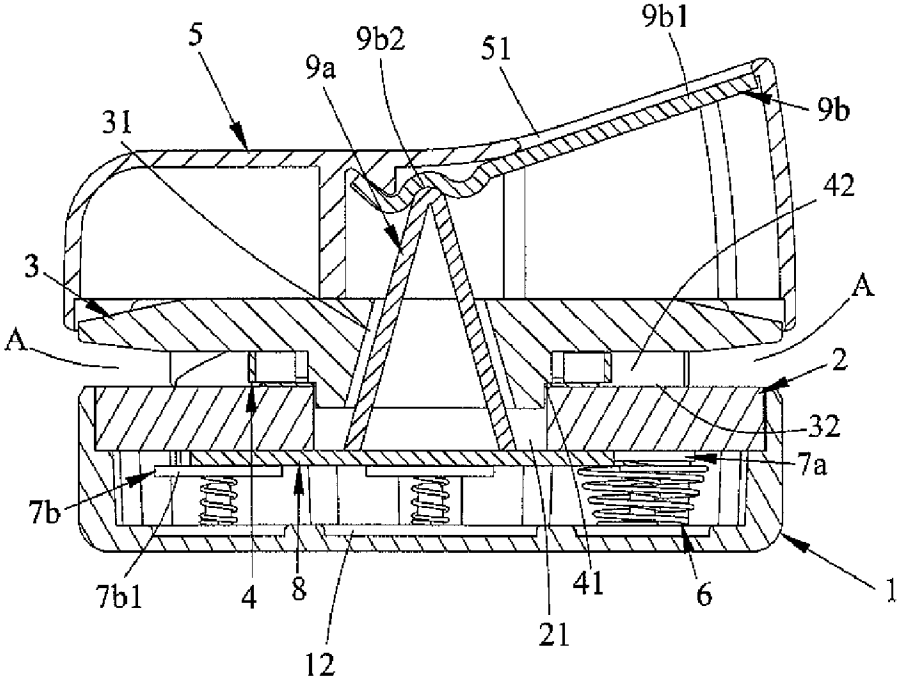
FIG. 6 is a cross sectional diagram illustrating the assembly of the seatbelt buckle for use in vehicle according to the present invention.
Figure 5:
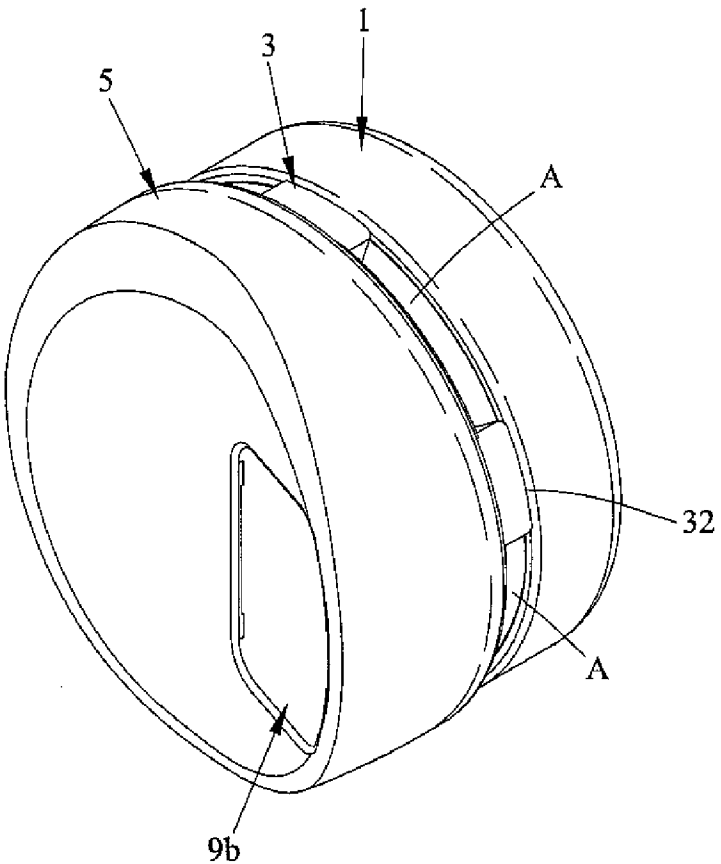
FIG. 5 is a perspective diagram illustrating the assembly of the seatbelt buckle for use in vehicle according to the present invention.
Figure 8:
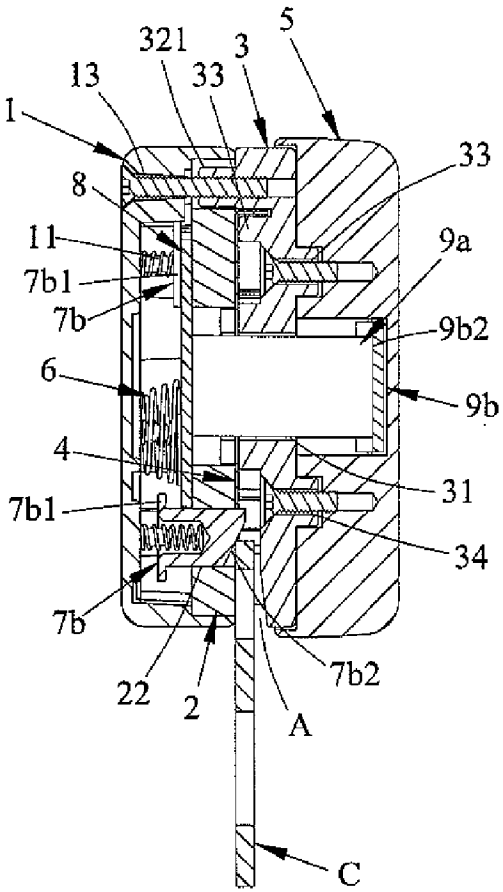
FIG. 8 is a cross sectional diagram illustrating the seatbelt buckle for use in vehicle of the present invention being buckled.

Referring to FIGS. 3-6, a seatbelt buckle for use in vehicle in accordance with the present invention comprises a base 1, an intermediate loop 2, a fixed disc 3, an elastic member 4, an upper cover 5, a fixed post 7*a*, four movable posts 7*b*, an actuation member 8, a biasing element 9*a* and a pressing element 9*b*, wherein the base 1 includes a plurality of pegs 11 and apertures 12 provided thereon, the intermediate loop 2 is constructed in the form of a circle and includes a central hole 21 formed at the center thereof, and includes a plurality of openings 22 and bores 23 arranged thereon, the fixed disc 3 is constructed in the form of a circle and includes a square tapered orifice 31 attached at the center thereof, and includes a number of projections 32, each having a hollow pillar 321 erected thereon, mounted at the bottom and adjacent to the rim thereof; a plurality of positioning tabs 33 in response to the inner sides of the projections 32, and two holes 34 affixed thereon. The elastic member 4 is constructed in the form of a star-shaped sheet and includes a through opening 41 arranged at the center thereof, a number of flexible pieces 42 fixed on the periphery thereof, and a plurality of positioning slots 43 defined at the corners thereof respectively. The upper cover 5 contains a receiving chamber 51 disposed at one side thereof, and the resilient element 6 is a conical spring, the fixed post 7*a* is extended outwardly and constructed in the form of a hollow cylinder, and the movable post 7*b* is also extended outwardly and constructed in the form of a hollow cylinder, and includes a peripheral bulge 7*b*1 mounted at one end thereof, a obliquely-cut retaining portion 7*b*2 secured at another end thereof; and two opposite confining planes 7*b*3 formed at the rim thereof. The actuation member 8 includes four indentions 81 attached thereon, four U-shaped notches 82 and an arcuate cut 83 formed on the rim thereof. The biasing element 9*a* is constructed in the shape of an inverted V-shaped sheet and includes four acting protrusions 9*a*1 provided at the bottoms thereof, the pressing element 9*b* is constructed in the form of a sheet 9*b*1, and one end thereof extends outwardly and includes a wave-shaped abutting segment 9*b*2 arranged thereon.

Figure 7:
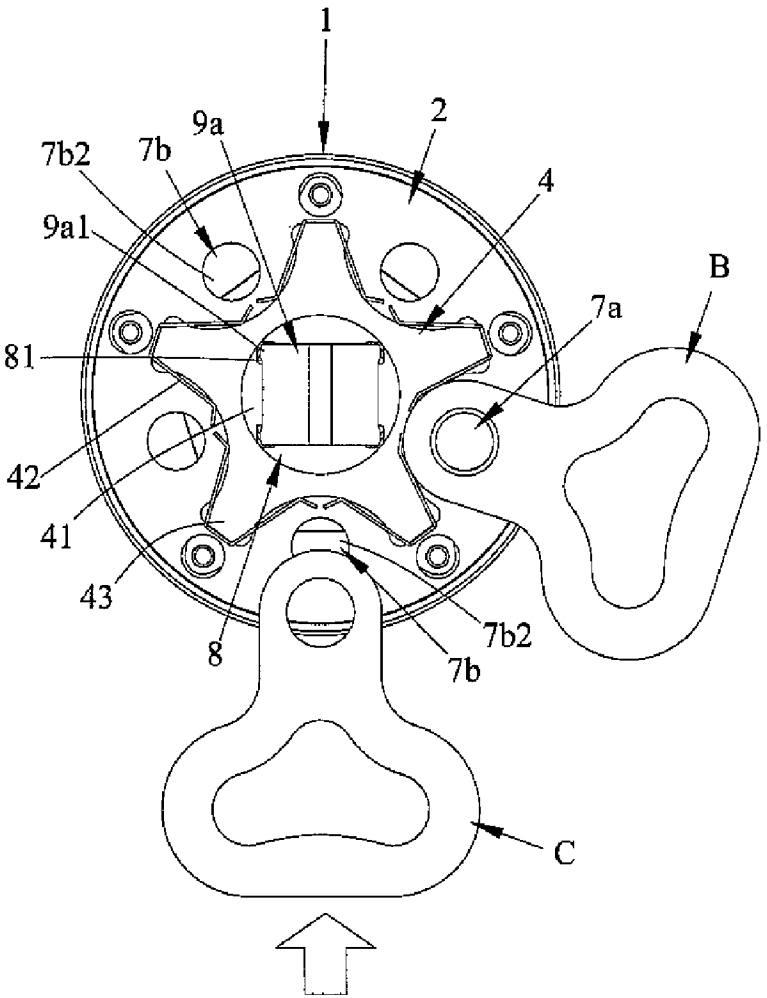
FIG. 7 is a plane diagram illustrating the seatbelt buckle for use in vehicle of the present invention being buckled.
Figure 10:
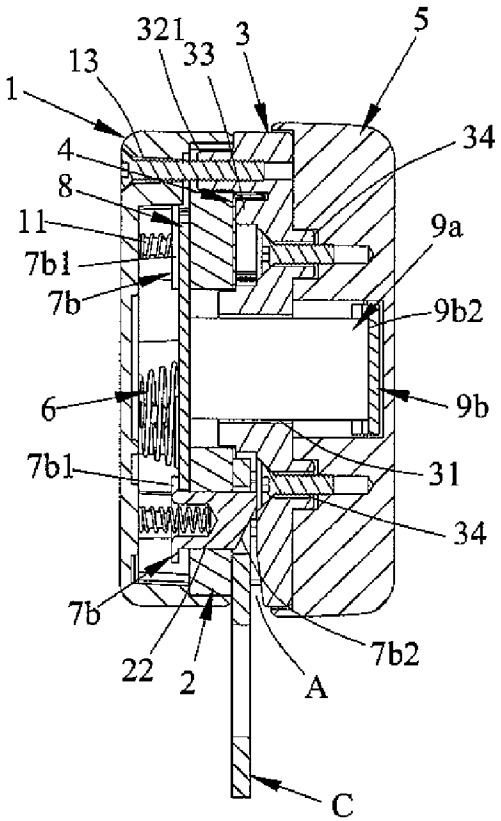
FIG. 10 is a cross sectional diagram illustrating the buckled state of the seatbelt buckle for use in vehicle of the present invention.
Figure 9:
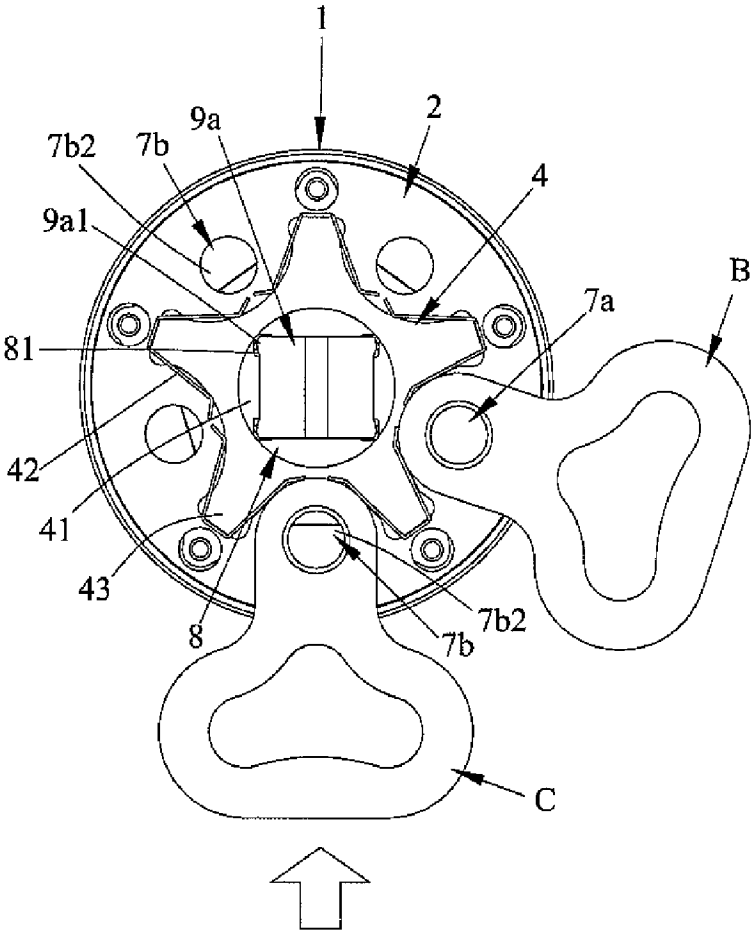
FIG. 9 is a plane diagram illustrating the buckled state of the seatbelt buckle for use in vehicle of the present invention.

In assembly, by using springs, the fixed and movable posts 7*a* and 7*b* are fitted onto the pegs 11 of the base 1 individually, and the resilient element 6 is fitted around the fixed post 7*a*, the actuation member 8 is placed into the base 1 so that the resilient element 6 elastically abuts against the base 1 and the actuation member 8, and the fixed and movable posts 7*a* and 7*b* are further slidably fitted in the notch 82 and the cut 83 of the actuation member 8 respectively and insert out of the openings 22 of the intermediate loop 2, the two opposite confining planes 7*b*3 of the movable post 7*b* contact with the notch 82 of the actuation member 8 such that the movable post 7*b* merely allows to displace upward and downward without rotation. Furthermore, the pressing element 9*b* is placed into the receiving chamber 51 of the upper cover 5, and the fixed disc 3 is placed onto the bottom of the upper cover 5, by screwing locking elements to combine with the upper cover 5 through the two holes 34 of the fixed disc 3, the pressing element 9*b* is secured between the upper cover 5 and the fixed disc 3. Thereafter, by placing the biasing member 9*a* onto the actuation member 8, the four acting protrusions 9*a*1 correspondingly contact with the four indentions 81 of the actuation member 8, and then the intermediate loop 2, the elastic member 4, the fixed disc 3, the upper cover 5 and the pressing element 9*b* are assembled onto the base 1 such that the biasing element 9*a* extends out of the central hole 21 of the intermediate loop 2, the through opening 41 of the elastic member 4, and the tapered orifice 31 of the fixed disc 3 to bias against the abutting segment 9*b*2 of the pressing member 9*b*, and the elastic member 4 is secured between the fixed disc 3 and the intermediate loop 2, the positioning slots 43 of the elastic member 4 engage with the positioning tabs 33 of the fixed disc 3, and the hollow pillars 321 insert into the bores 23 of the fixed disc 3, by way of the projections 32 of the fixed disc 3, five snap-on recesses A between the fixed disc 3 and the intermediate loop 2 form, and by screwing screw elements to combine with the hollow pillars 321 of the fixed disc 3 through the apertures 12 of the base 1, the assembly of the seatbelt buckle may be obtained. Moreover, a fixed engaging member B (as shown in FIG. 7) may be easily inserted into the predetermined snap-on recess A for engaging with the movable post 7*a*.

As illustrated in FIGS. 7-11, in operation, a movable engaging member C of the seatbelt is inserted from the snap-on recess A and presses against the movable post 7*b* along the retaining portion 7*b*2 so that the movable post 7*b* displaces downwardly to compress the spring, and after the movable engaging member C has been inserted for positioning, the movable post 7*b* is pushed to return its initial position by means of the spring, hence securely retaining the movable engaging member C onto the movable post 7*b*.

Figure 12:
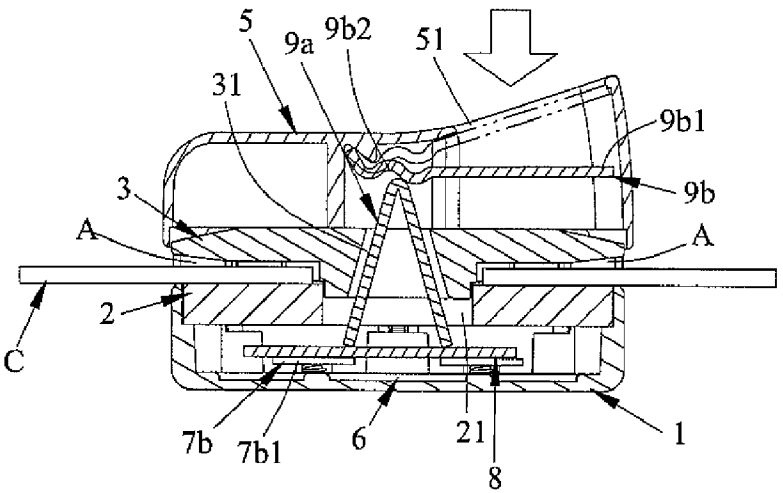
FIG. 12 is a cross sectional diagram illustrating the seatbelt buckle for use in vehicle of the present invention being unbuckled.
Figure 11:
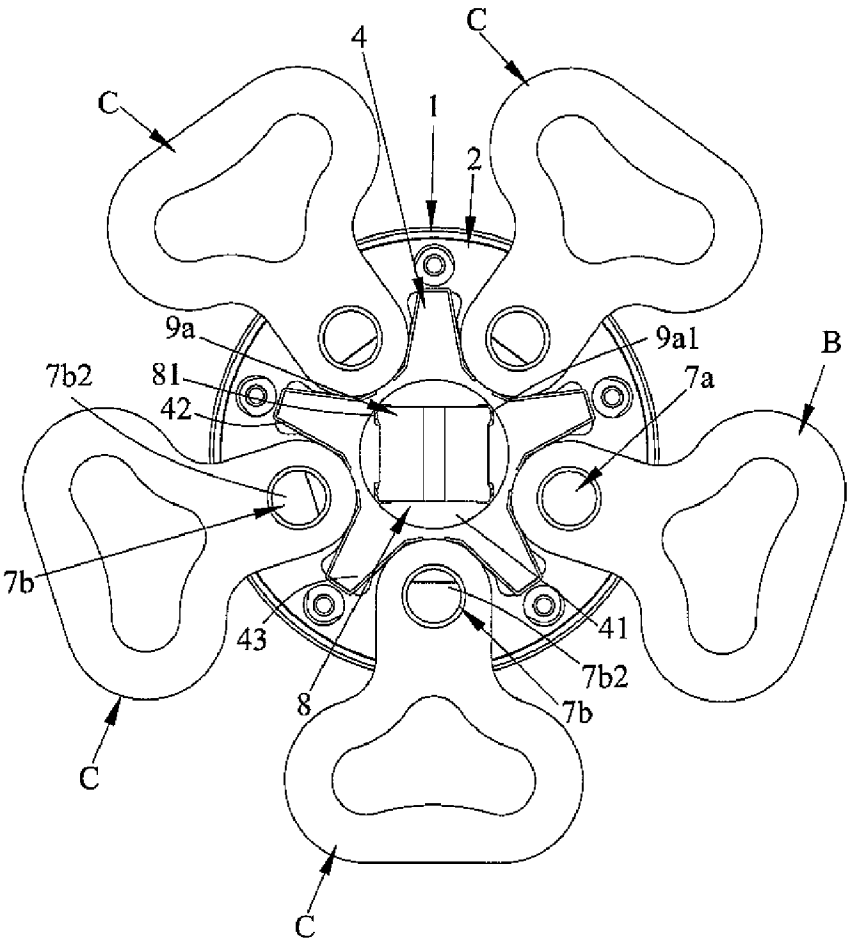
FIG. 11 is a plane diagram illustrating the operational state of the seatbelt buckle for use in vehicle of the present invention.
Figure 14:
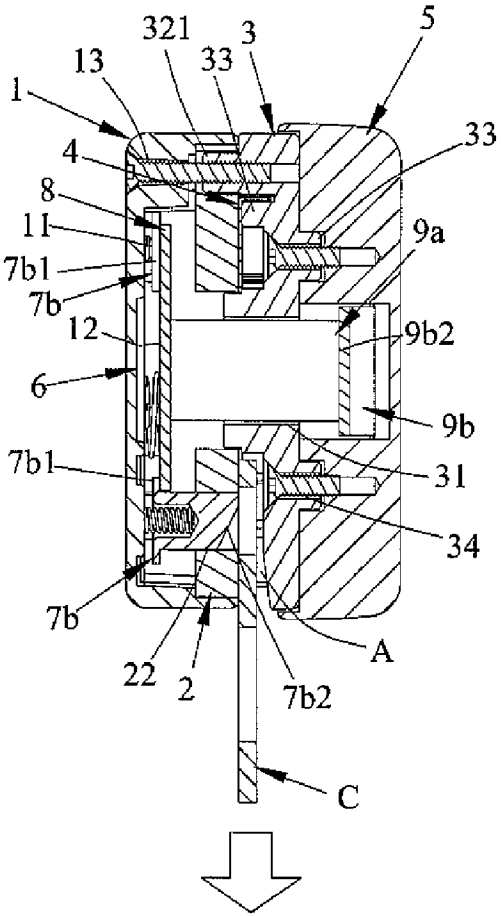
FIG. 14 is a cross sectional diagram illustrating the movable engaging member of the present invention being disengaged.
Figure 13:
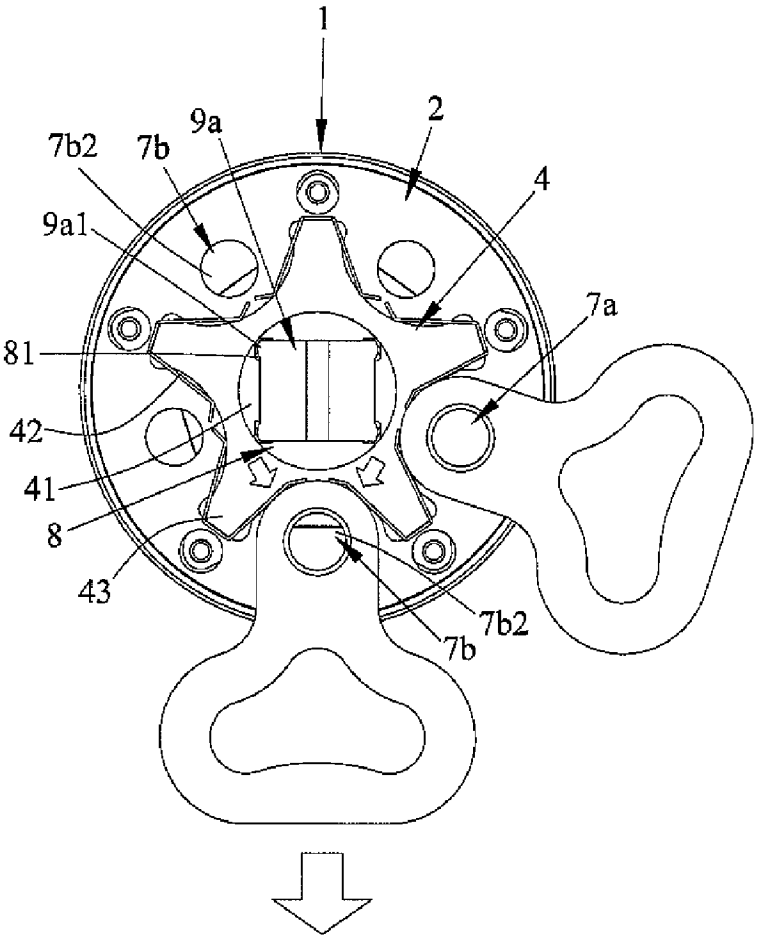
FIG. 13 is a plane diagram illustrating a movable engaging member of the present invention being disengaged.

With reference to FIGS. 12-14, as unbuckling the seatbelt, the pressing element 9*b* is buttoned downward from the sheet 9*b*1 so as to urge the biasing element 9*a* to act against the actuation member 8 downward, such that the peripheral bulge 7*b*1 are pushed downward to urge the movable post 7*b* to move downward and disengage from the movable engaging member C, thereby enabling to utilize the flexible piece 42 of the elastic member 4 to push the movable engaging member C out of the snap-on recess A. After the disengagement of the seatbelt, by virtue of the spring and the resilient element 6, the movable post 7*b*, the actuation member 8, the biasing element 9*a* and the pressing element 9*b* are pushed to return their initial positions.

It can be clearly seen from the preceding accounts on the features of the present invention that the seatbelt buckle for use in vehicle of the present invention has the following advantages:

1. Simplifying the structure of the seatbelt buckle and facilitating the manufacturing processes. Besides, the assembly of the elastic member 4 is quite easy, thereby lowering the production cost thereof.

2. Due to the torque of the pressing element 9*b* is smaller, saving force during the disengagement of the movable engaging member C.

The invention is not limited to the above embodiment but various modifications thereof may be made. It will be understood by those skilled in the art that various changes in form and detail may made without departing from the scope and spirit of the present invention.

What is claimed is:

1. A seatbelt buckle for use in vehicle comprising:

a base, an intermediate loop, a fixed disc, an elastic member, an upper cover, a fixed post, four movable posts, an actuation member, a biasing element and a pressing element, wherein said base includes a plurality of pegs provided thereon, by using springs, said fixed post and movable posts are fitted onto pegs of said base and further slidably fitted in a notch and cuts in said actuation member respectively, said intermediate loop is constructed in the form of a circle and includes a central hole formed at the center thereof, and includes a plurality of openings and bores arranged thereon, the fixed disc is constructed in the form of a circle and includes a square tapered orifice attached at the center thereof, and includes a number of projections, each having a hollow pillar erected thereon, mounted at the bottom and adjacent to the rim thereof, a plurality of positioning tabs in response to the inner sides of said projections, said elastic member includes a through opening arranged at the center thereof, a number of flexible pieces fixed on the periphery thereof, and a plurality of positioning slots defined at the corners thereof respectively, said intermediate loop and said fixed disc are screwed onto said base, said elastic member is secured between said fixed disc and said intermediate loop, and a plurality of snap-on recesses form between said fixed disc and said intermediate loop for the insertion of engaging members of the seatbelt, and a resilient element is fitted around said fixed post, said actuation member includes a number of indentions attached thereon, for correspondingly contacting with acting protrusions of said biasing element, which is constructed in the form of an inverted V-shaped sheet, so as to extend out of said central hole of said intermediate loop, said through opening of said elastic member, and said tapered orifice of said fixed disc to bias against an abutting segment of said pressing member.

2. The seatbelt buckle for use in vehicle as claimed in claim 1, wherein said biasing member includes a plurality of acting protrusions provided at the bottoms thereof.

3. The seatbelt buckle for use in vehicle as claimed in claim 1, wherein said pressing element is constructed in the form of a sheet, and one end thereof extends outwardly and includes a wave-shaped abutting segment arranged thereon.

4. The seatbelt buckle for use in vehicle as claimed in claim 1, wherein said fixed disc is engageably placed onto the bottom of said upper cover, by screwing locking elements to combine with said upper cover through two holes of said fixed disc.

5. The seatbelt buckle for use in vehicle as claimed in claim 1, wherein said positioning slots of said elastic member engage with said positioning tabs of said fixed disc, and said hollow pillars insert into said bores of said fixed disc.

6. The seatbelt buckle for use in vehicle as claimed in claim 1, wherein said elastic member is constructed in the form of a star-shaped sheet.

7. The seatbelt buckle for use in vehicle as claimed in claim 1, wherein said openings of said intermediate loop receive said fixed and movable posts.

* * * * *